US011454088B1

(12) United States Patent
Leon et al.

(10) Patent No.: US 11,454,088 B1
(45) Date of Patent: Sep. 27, 2022

(54) RUPTURE DISK, METHOD AND SYSTEM

(71) Applicants: Claudia Leon, Houston, TX (US); Farhat Shaikh, Houston, TX (US); Joshua Raymond Snitkoff, Houston, TX (US); Brandon Decuir, Houston, TX (US); Rohan Buntval, Manvel, TX (US)

(72) Inventors: Claudia Leon, Houston, TX (US); Farhat Shaikh, Houston, TX (US); Joshua Raymond Snitkoff, Houston, TX (US); Brandon Decuir, Houston, TX (US); Rohan Buntval, Manvel, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/318,456

(22) Filed: May 12, 2021

(51) Int. Cl.

| | |
|---|---|
| ***E21B 34/06*** | (2006.01) |
| ***E21B 17/01*** | (2006.01) |
| ***E21B 17/00*** | (2006.01) |

(52) U.S. Cl.
CPC ..... *E21B 34/063* (2013.01); *E21B 17/003* (2013.01); *E21B 17/01* (2013.01)

(58) Field of Classification Search
CPC ..... E21B 34/063; E21B 17/01; E21B 17/003; E21B 34/103
See application file for complete search history.

(56) References Cited

U.S. PATENT DOCUMENTS

| | | | | |
|---|---|---|---|---|
| 3,445,032 | A | 5/1969 | Hansen et al. | |
| 6,178,983 | B1 * | 1/2001 | Culliinane | F16K 17/1606 137/68.26 |
| 6,378,544 | B1 * | 4/2002 | DiBello | F16K 17/16 137/68.25 |
| 6,446,653 | B2 * | 9/2002 | Cullinane | F16K 17/1606 137/68.25 |
| 9,551,429 | B2 * | 1/2017 | Walker | F16K 17/1606 |
| 9,593,542 | B2 * | 3/2017 | Getzlaf | E21B 33/146 |
| 10,184,308 | B2 * | 1/2019 | Chauffe | E21B 34/103 |
| 10,228,068 | B2 * | 3/2019 | Goggin | F16K 17/16 |
| 10,316,979 | B2 * | 6/2019 | Petrowsky | F16K 17/162 |
| 2009/0302035 | A1 * | 12/2009 | Shaw | F16K 17/1606 220/89.2 |
| 2011/0284243 | A1 | 11/2011 | Frazier | |
| 2014/0008085 | A1 | 1/2014 | Tinnen | |
| 2017/0204703 | A1 * | 7/2017 | Mair | E21B 43/11855 |
| 2018/0283121 | A1 * | 10/2018 | Zhang | E21B 47/06 |
| 2020/0009666 | A1 * | 1/2020 | Krebill | B23K 26/364 |
| 2021/0071492 | A1 * | 3/2021 | Fripp | E21B 34/063 |

* cited by examiner

*Primary Examiner* — Aaron L Lembo
(74) *Attorney, Agent, or Firm* — Cantor Colburn LLP

(57) ABSTRACT

A burst disk including a body, and a stress riser unexposed to fluidic environment outside of the body.

15 Claims, 4 Drawing Sheets

RUPTURE DISK, METHOD AND SYSTEM

BACKGROUND

In the resource recovery and carbon dioxide sequestration industries, rupture disks are often used for various utilities. Generally, such disks work well for their intended purposes, but they do tend to suffer from fragmentation in ways that leave too large fragments that can interfere with other wellbore operations. This is clearly undesirable, and the art would well receive alternate constructions that avoid the unfortunate fragmentation.

SUMMARY

An embodiment of a burst disk including a body, and a stress riser unexposed to fluidic environment outside of the body.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
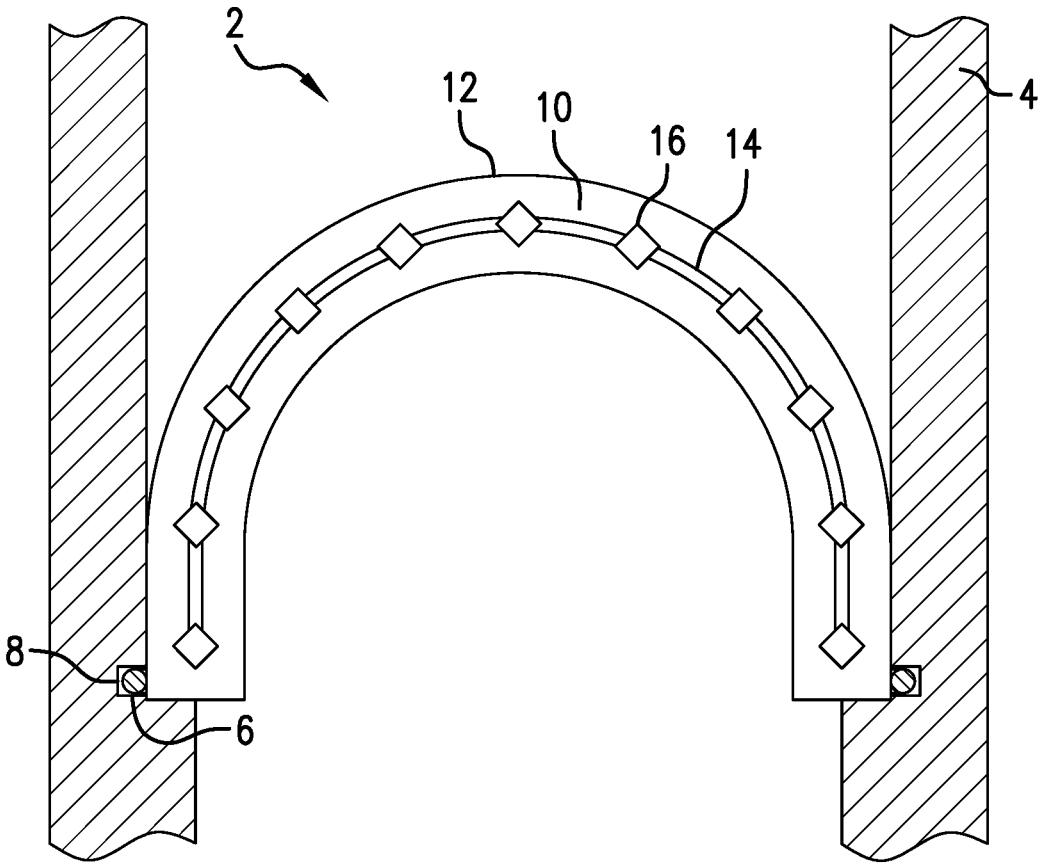
FIG. 1 is a schematic cross-sectional illustration of a first embodiment of a rupture disk as disclosed herein.
Figure 2:
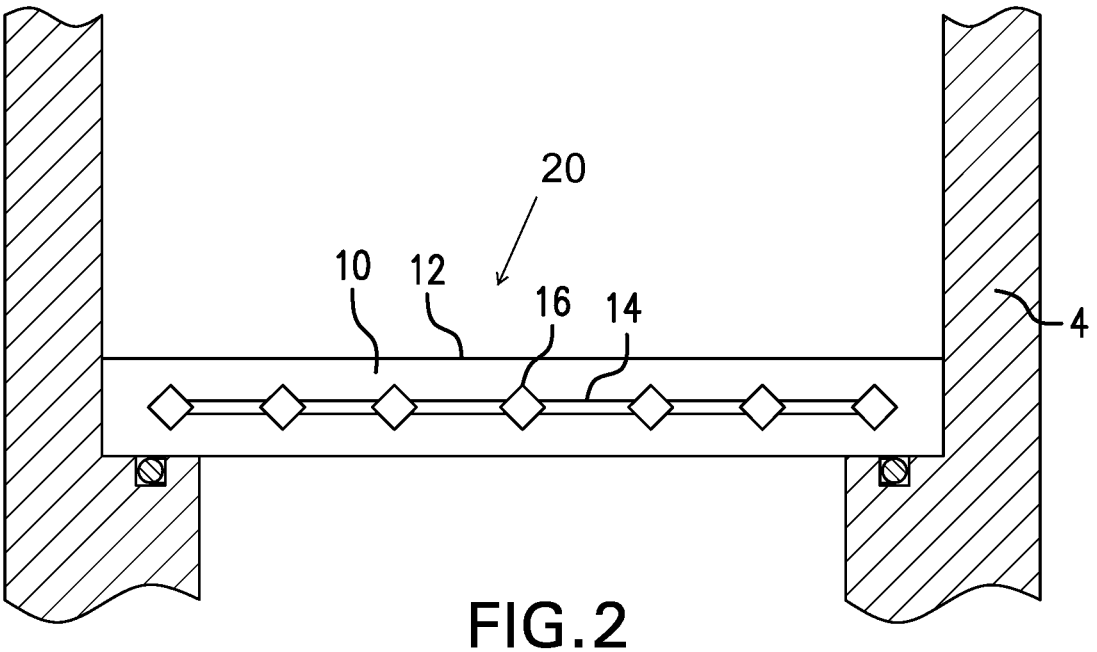
FIG. 2 is a schematic cross-sectional illustration of a second embodiment of a rupture disk as disclosed herein.
Figure 3:
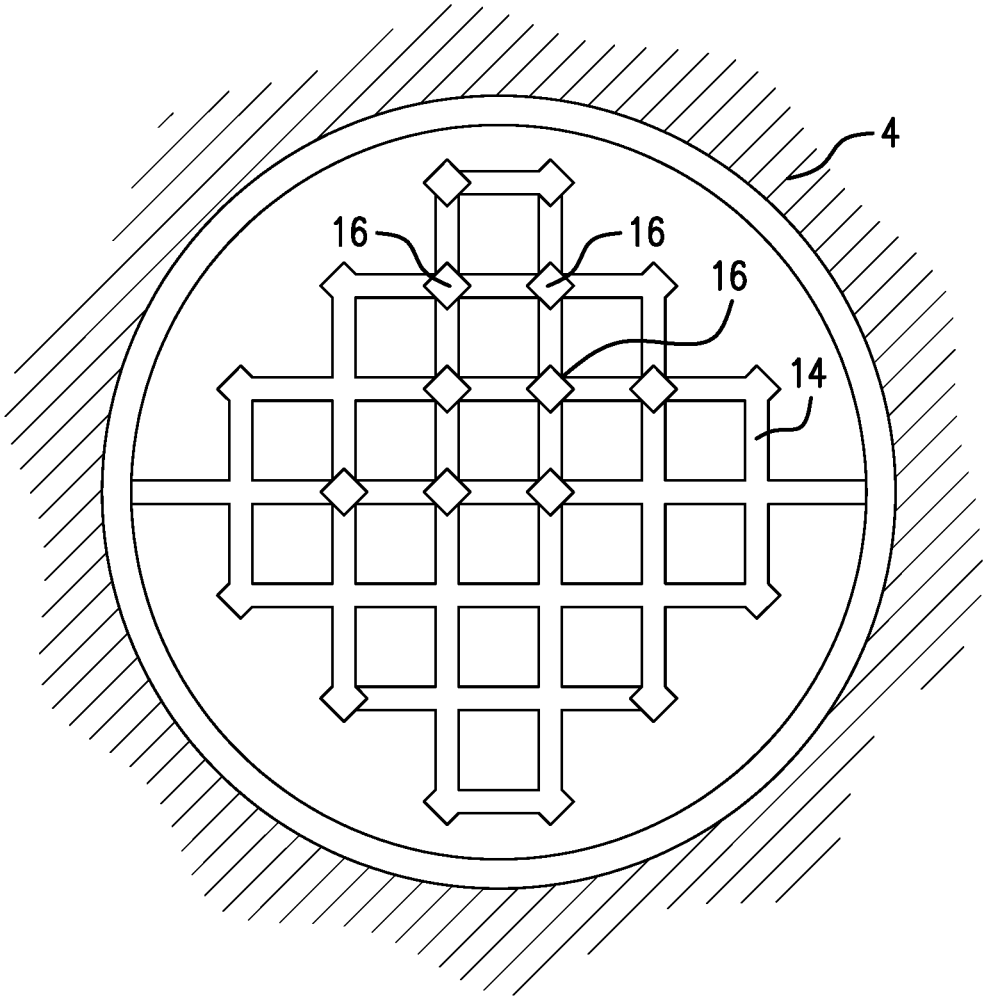
FIG. 3 is a schematic plan illustration of the second embodiment of a rupture disk as disclosed herein.
Figure 4:
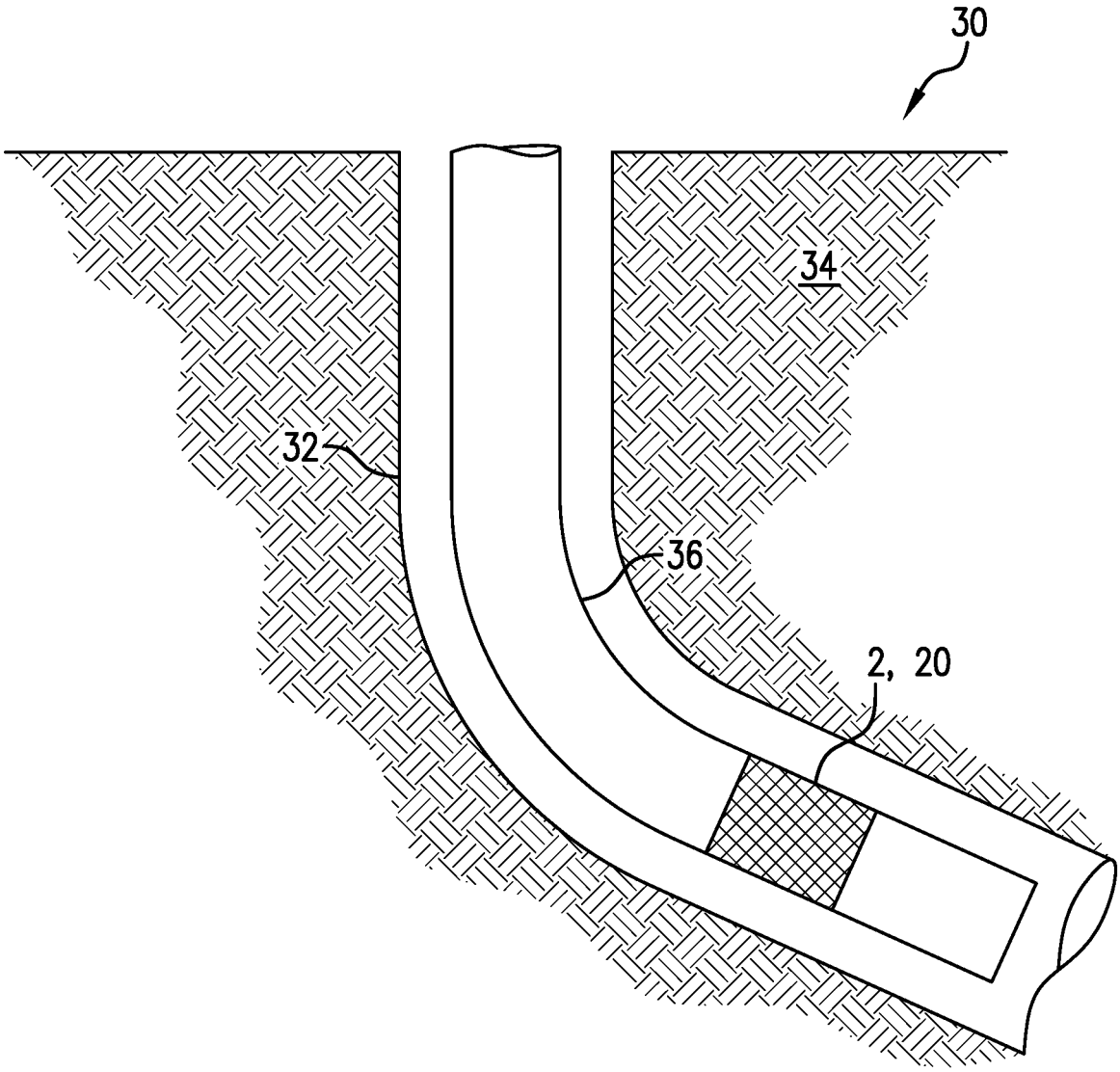
FIG. 4 is a schematic illustration of a wellbore system including the rupture disk as disclosed herein.

Referring to FIGS. 1-3, a first embodiment of a rupture disk 2 and a second embodiment of a rupture disk 20 is illustrated. The two embodiments operate in the same manner but use different geometries where disk 2 is domed and disk 20 is flat. Detailed discussion directed at FIG. 1 is applicable to FIGS. 2 and 3. In the FIG. 1 embodiment, the disk 2 exhibits a dome shaped geometry. Such geometries are useful in certain situations for the enhanced strength that the arch constitution brings. The disk 2 may be placed within a tubing member 4 abutting a shoulder 6 and sealed with a seal 8 such as an O-ring. Pressure will be upstream of the disk 2, which is toward a top of the FIG. 1. Disk 2 includes a body 10 having a surface 12 and a stress riser 14 within the body 10 that is unexposed to a fluidic environment outside of the body 10. By "unexposed to fluidic environment outside of the body", it is meant that the entirety of the stress riser 14 is disposed within the confines of the body 10, the surface 12 of the body 10 being unbroken by the stress riser 14. Surface 12 may be an actual surface of a material of the body 10 or may be a coating disposed upon that material and still be considered the surface 12 of body 10. In either case, the stress riser 14 will be protected from contact with a fluidic environment outside of the surface 12.

The body may comprise a ceramic material in some cases and may also comprise other frangible materials and may be additively manufactured or cast. The stress riser 14 disposed within the body 10 has for its purpose to cause fracturing of the body 10 into pieces small enough and of a shape that will not interfere with other well operations. To this end, stress risers 14 may be one or more and may be intersecting or non-intersecting. Any condition of the body that tends to increase stress at the stress riser may be employed. Among stress risers contemplated, but not limited thereto, are discrete differences such as hollows in the body 10, different materials placed within the body 10, different material properties of the same material within the body 10, materials having differing coefficients of thermal expansion (CTE) from the body or from each other disposed within the body 10, conductive materials disposed within the body 10, etc. In each case, the riser 14 ultimately causes fracture on lines including the stress riser 14 and that are preconceived to result in fragmentation of the rupture disk 2 in a way that is non-deleterious to the balance of the well. Even greater control of the fracture patterns may be achieved through the addition of fracture nodes 16 that cause even greater stress in the body 10. Fractures begin at the nodes 16 and propagate along risers 14. Nodes may have shapes that create sharp points since a point is always a stress riser but also may be rounded in shape yet still reduce the thickness of body 10 at the location of the node 16 to weaken the structure of the body 10.

In the cases of hollows or different materials or properties of materials, the stress riser is passive. That is to say, the material within the stress risers 14 is simply less capable of holding a load and hence will fail in that location first. In the case of materials having differing CTE, the configuration may be one in which the material having differing CTE fills the pattern illustrated in the figures and with temperature change will create stress relative to the CTE of the body 10 material. In the case of multiple materials each having its own CTE disposed in the pattern illustrated, a temperature change will cause the paired materials to curve in a direction toward the lower CTE material. This causes a mechanical stress in the disk 2 that can initiate fracture formation. In the case of the conductive material used as a stress riser, and although that material too may be used passively, it may also be active. Particularly, conductive material will carry a current. If a sufficient current is applied to the conductive material, the material is increase in temperature. There is always a coefficient of thermal expansion and if conductive materials having a substantial coefficient of thermal expansion are used, then heating those materials through the application of current thereto, will develop an active internal stress in the body 10. The body 10 may therefore be ruptured by the application of current to the conductive stress riser 14 or node 16.

It is to be appreciated that combinations of types of stress risers 14 and/or nodes 16 may be made without departing from the scope of the invention. For example, it may be that lower strength materials (differing material or differing material property) used in a web and that at intersections of the web, hollows may be placed to act as the fracture node 16. This is an example only and other combinations are also contemplated.

The disks 2, 20 disclosed herein may be ruptured with fluid pressure, solid object contact, current or combinations including at least one of the foregoing.

A wellbore system 30 is also disclosed including a borehole 32 in a subsurface formation 34. A string 36 is disposed in the borehole 32 and a rupture disk 2, 20 is disposed with the string 36.

Set forth below are some embodiments of the foregoing disclosure:

Embodiment 1: A burst disk including a body, and a stress riser unexposed to fluidic environment outside of the body.

Embodiment 2: The disk as in any prior embodiment, wherein the body comprises a plurality of materials.

Embodiment 3: The disk as in any prior embodiment, wherein the stress riser is a web of interconnected features.

Embodiment 4: The disk as in any prior embodiment, wherein the web of interconnected features includes a fracture node disposed along the web.

Embodiment 5: The disk as in any prior embodiment, wherein the fracture node is at an intersection of the web.

Embodiment 6: The disk as in any prior embodiment, wherein the stress riser is a hollow.

Embodiment 7: The disk as in any prior embodiment, wherein the stress riser is a different material than an adjacent volume of the body.

Embodiment 8: The disk as in any prior embodiment, wherein the stress riser is a different material property of the same material as an adjacent volume of the body.

Embodiment 9: The disk as in any prior embodiment, wherein the stress riser is a conductive material.

Embodiment 10: The disk as in any prior embodiment, wherein the conductive material in response to current supplied thereto expands volumetrically.

Embodiment 11: The disk as in any prior embodiment, wherein the stress riser is a material having a differing coefficient of thermal expansion than a material of the body.

Embodiment 12: The disk as in any prior embodiment, wherein the stress riser is a pair of materials disposed adjacent one another within the body and having differing coefficients of thermal expansion from each other.

Embodiment 13: The disk as in any prior embodiment, wherein the stress riser is a pattern that defines an area of each fragment of the body after rupture.

Embodiment 14: A method for managing fragment size from a rupture disk including pressuring against a disk as in any prior embodiment fracturing the disk along stress risers in the disk, and producing select size fragments of the disk.

Embodiment 15: A wellbore system including a borehole disposed in a subsurface formation, a string disposed in the borehole, and a rupture disk as in any prior embodiment disposed with the stirring.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A burst disk comprising:

a body; and a stress riser unexposed to a fluidic environment outside of the body.

2. The disk as claimed in claim 1 wherein the body comprises a plurality of materials.

3. The disk as claimed in claim 1 wherein the stress riser is a web of interconnected features.

4. The disk as claimed in claim 2 wherein the web of interconnected features includes a fracture node disposed along the web.

5. The disk as claimed in claim 3 wherein the fracture node is at an intersection of the web.

6. The disk as claimed in claim 1 wherein the stress riser is a hollow.

7. The disk as claimed in claim 1 wherein the stress riser is a different material than an adjacent volume of the body.

8. The disk as claimed in claim 1 wherein the stress riser is a different material property of the same material as an adjacent volume of the body.

9. The disk as claimed in claim 1 wherein the stress riser is a conductive material.

10. The disk as claimed in claim 9 wherein the conductive material in response to current supplied thereto expands volumetrically.

11. The disk as claimed in claim 1 wherein the stress riser is a material having a differing coefficient of thermal expansion than a material of the body.

12. The disk as claimed in claim 1 wherein the stress riser is a pair of materials disposed adjacent one another within the body and having differing coefficients of thermal expansion from each other.

13. The disk as claimed in claim 1 wherein the stress riser is a pattern that defines an area of each fragment of the body after rupture.

14. A method for managing fragment size from a rupture disk comprising:

pressuring against a disk as claimed in claim 1;

fracturing the disk along stress risers in the disk; and producing select size fragments of the disk.

15. A wellbore system comprising:

a borehole disposed in a subsurface formation;

a string disposed in the borehole; and a rupture disk as claimed in claim 1 disposed with the string.

* * * * *